US005632290A

United States Patent [19]

Ling Kuo

[11] Patent Number: 5,632,290

[45] Date of Patent: May 27, 1997

[54] AUTOMATICALLY COLLAPSIBLE UMBRELLAS

[76] Inventor: Cheng M. Ling Kuo, No. 18, Alley 15, Lane 582, Sea Ta Road, Hsinchu, Taiwan, Taiwan

[21] Appl. No.: 699,107

[22] Filed: Aug. 16, 1996

[51] Int. Cl.[6] ..... A45B 25/14

[52] U.S. Cl. ..... 135/24; 135/28; 135/25.4

[58] Field of Search ..... 135/22, 24, 28, 135/25.4, 25.41, 37, 38, 39, 40, 41

[56] References Cited

U.S. PATENT DOCUMENTS

| | | | |
|---|---|---|---|
| 3,424,180 | 1/1969 | Andolfi | 135/28 X |
| 4,573,487 | 3/1986 | Schultes et al. | 135/24 |
| 5,178,174 | 1/1993 | Wu | 135/24 X |
| 5,232,004 | 8/1993 | Wu | 135/24 |
| 5,275,186 | 1/1994 | Liu | 135/25.4 X |
| 5,492,140 | 2/1996 | Lin et al. | 135/22 X |
| 5,505,222 | 4/1996 | Lin et al. | 135/24 |

*Primary Examiner*—Lanna Mai

*Attorney, Agent, or Firm*—Morton J. Rosenberg; David I. Klein

[57] ABSTRACT

The present invention relates to an automatically collapsible umbrella, and especially to an improved mechanism that governs the opening and collapsing of an automatic umbrella. With the inventive control mechanism that comprises two innovative lock plates and a specially designed runner, an automatic umbrella can be more precisely manipulated without malfunction or be inadvertently triggered.

1 Claim, 5 Drawing Sheets

AUTOMATICALLY COLLAPSIBLE UMBRELLAS

BACKGROUND OF THE INVENTION

The current development of an umbrella has reached a point where an umbrella can provide great convenience for users by a feature of automatically opening and closing the umbrella by pressing down a button. The shaft of such an umbrella needs to be compressed to store spring energy when collapsing it and to be locked by a control mechanism in the umbrella handle that governs the opening and closing of the umbrella. There are many sorts of control mechanisms that can provide such a function.

The object of the present invention is to provide an automatically opening and collapsing umbrella that has an innovative control mechanism, which has an effective location means for governing the opening and closing the umbrella and is easily assembled in manufacturing. The mechanism according to the invention can provide the enhancement in its performance.

BRIEF DESCRIPTION ACCOMPANYING DRAWINGS

Now the structure and features of the invention will be described below in detailed with reference to the accompanying drawings in which:

FIG. 1 exploded view of a control mechanism of an automatically collapsible umbrella according to this invention.

DETAILED DESCRIPTION OF A PREFERRED EMBODIMENT

Figure 1:
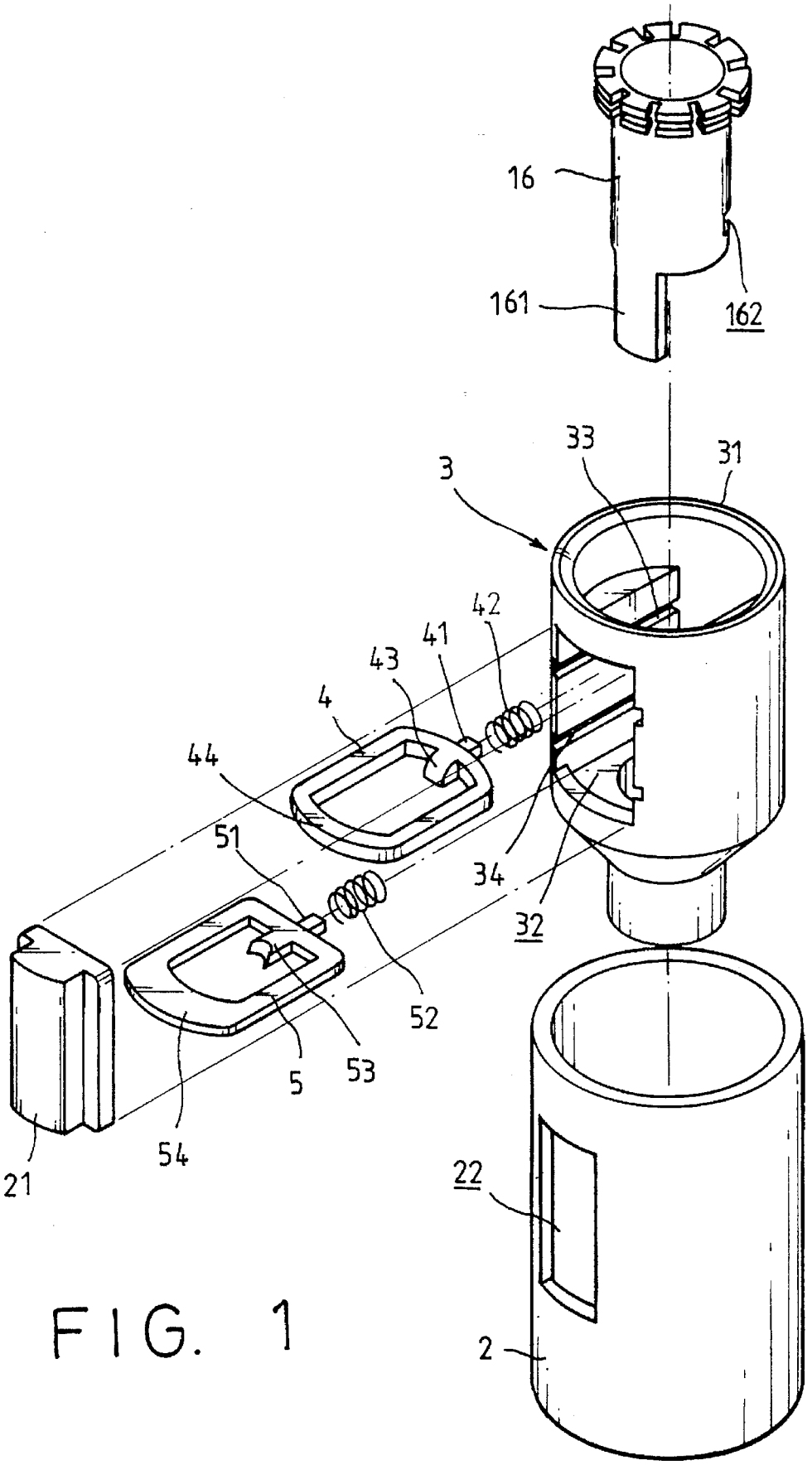
Figure 2:
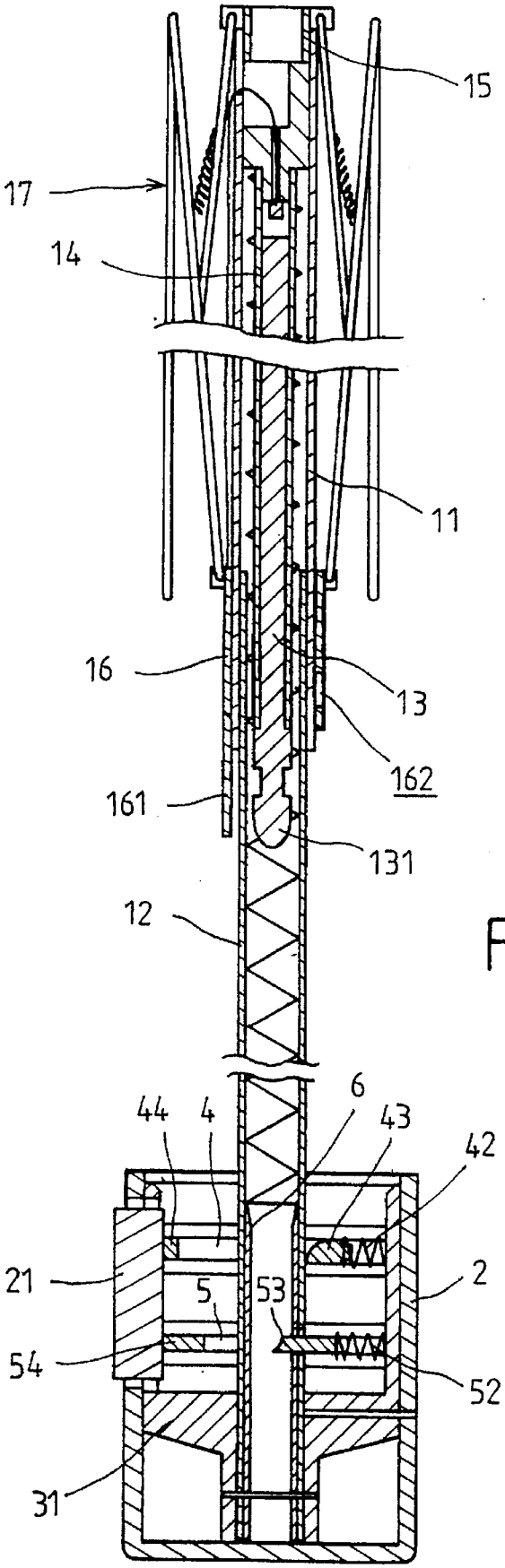
FIG. 2 is a cross-sectional view of the umbrella assembly structure according to the invention.

Now referring to the FIGS. 1 and 2, the control mechanism according to the invention comprises an outer tube (11), an inner tube (12), a mandrel (13), and a positioning rod (14). These components, accompanied by a holding ring (15) and a runner (16) connected to an umbrella rib assembly (17), constitutes a main functional body. The above-mentioned parts are conventional and known. Hence they will not be further described in detail here. The improvements of the present invention mainly consist in the control mechanism (3) inside the umbrella handle (2) and the shape of the runner (16).

The control mechanism (3) according to the invention comprises a main body (31) which is located inside the handle (2). A rectangular hole (32) is formed on one side of the main body (31), which is in a position corresponding to a rectangular opening (22) on the umbrella handle (2) that receives a button (21). Two elongated grooves (33), (34) are formed in the main body (31) being perpendicular to the hole (32) to engage with two corresponding lock plates (4), (5). The upper ring-shape lock plate (4) has an outward projection (41) which is capable of receiving a spring (42) and has the opposite ringside (44) to contact with inner face of the button (21). An inward tongue (43) is formed related to the projection (41). The lower lock plate (5) is similar to the upper lock plate (4), which has a projection (51) with a spring (52), a ringside (54) contacting with inner face of the button (21), and a related tongue (53) with curving face. The ringside (54) is wider than the ringside (44) of the upper lock plate (4) that means the central opening of the upper plate (4) is larger than of the lower one.

The runner (16) according to this invention has a downward extending plate (161) and an engaging groove (162) on its other side. When assembling, as in FIG. 2, the inner tube (12) with a sleeve (6) is connected to the control mechanism (3) wherein the tongue (53) of the lower lock plate (5) is inserted into the inner tube (12) and the sleeve(6).

Figure 3:
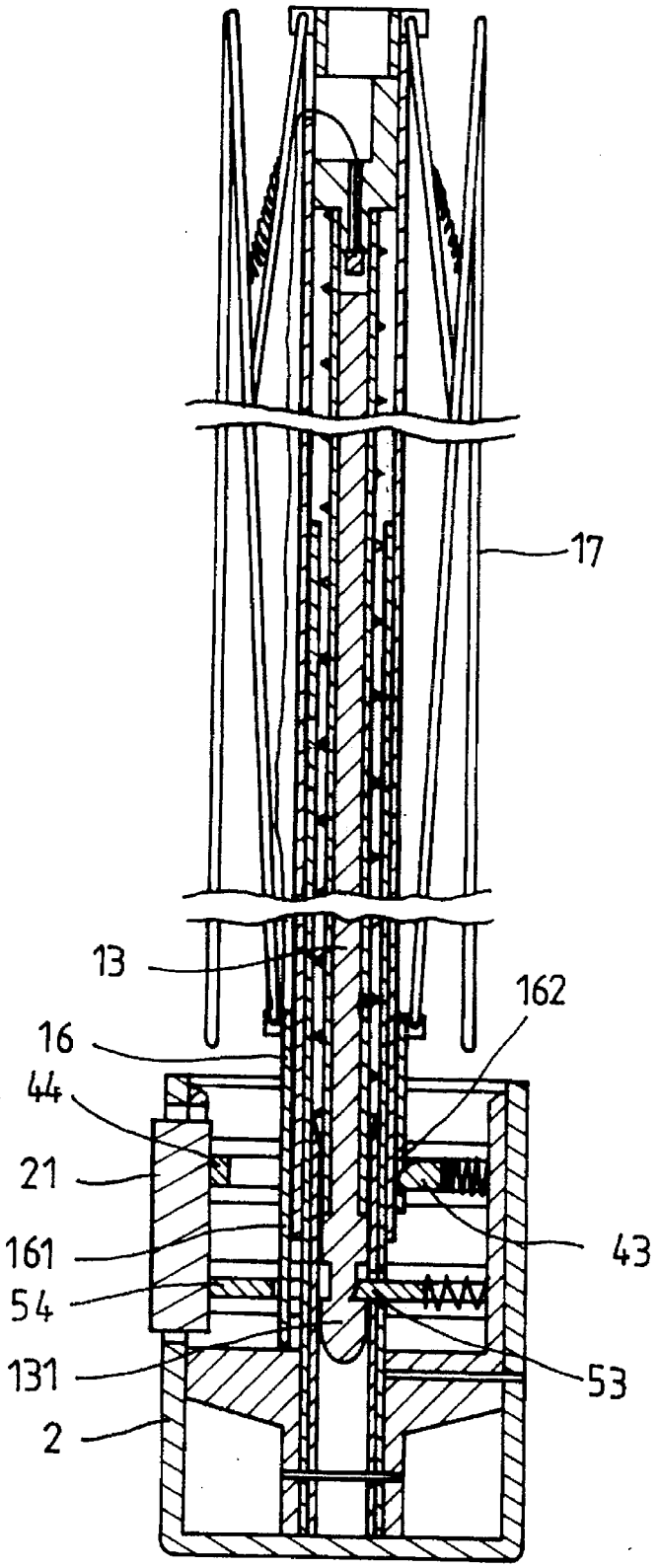
FIG. 3 is a cross-sectional view of the umbrella in a state that the umbrella rod is contracted.

In the operation of the control mechanism, the inner tube and the outer tube are first pressed down as shown in FIG. 3. The bullet-shaped end (131) of the mandrel (13) is locked by the tongue (53) of the lower lock plate (5). The engaging groove (162) of the runner (16) is locked by the tongue (43) of the upper lock plate (4) and the extending plate (161) is inserted into the central openings of the two lock plates. In this states, since the runner is partly merged in the handle, the total length of the umbrella will be shorter than a prior one that makes convenience on carrying and operating.

Figure 4:
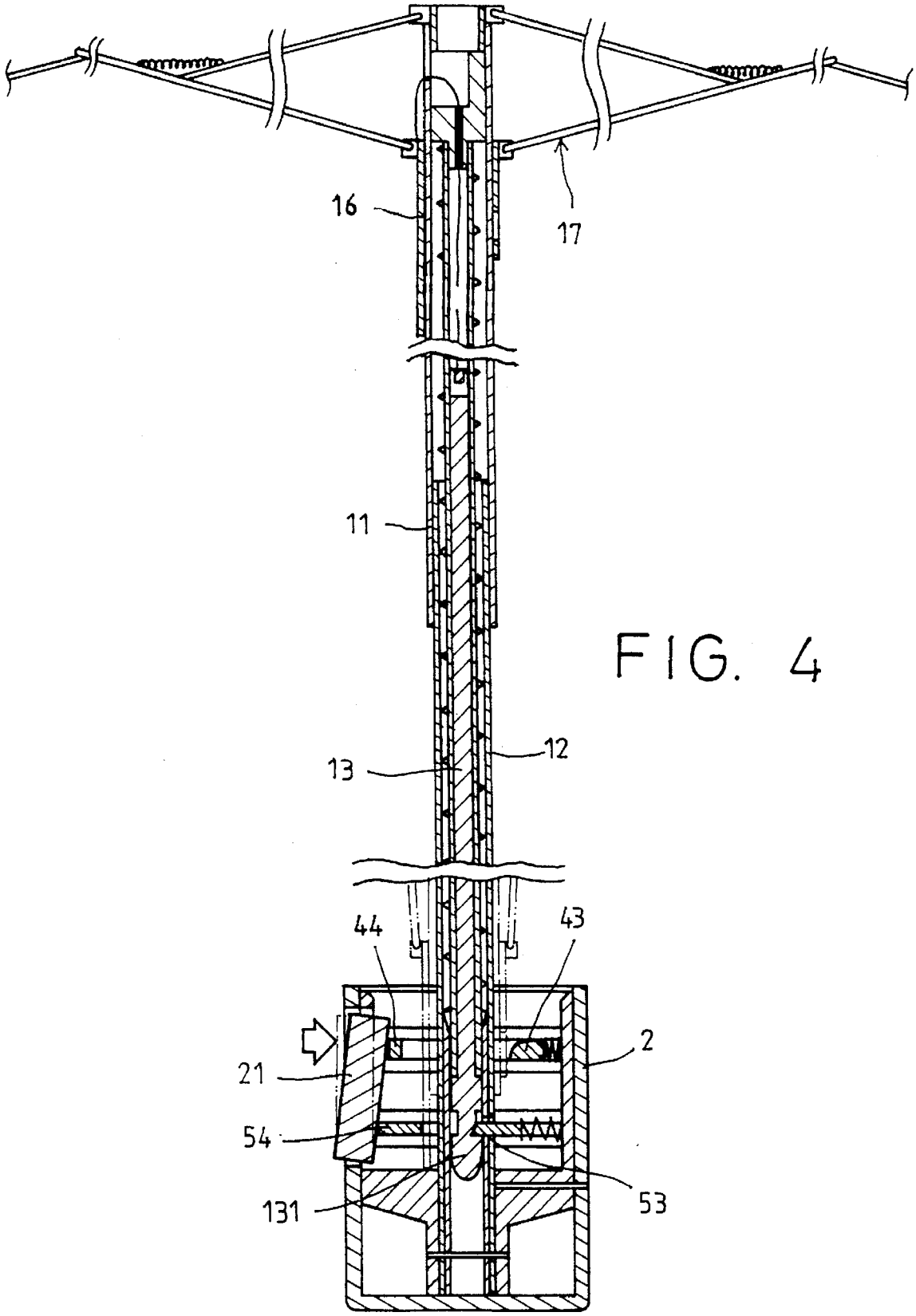
FIG. 4 is a cross-sectional view of the umbrella in a state that the umbrella is opened.
Figure 5:
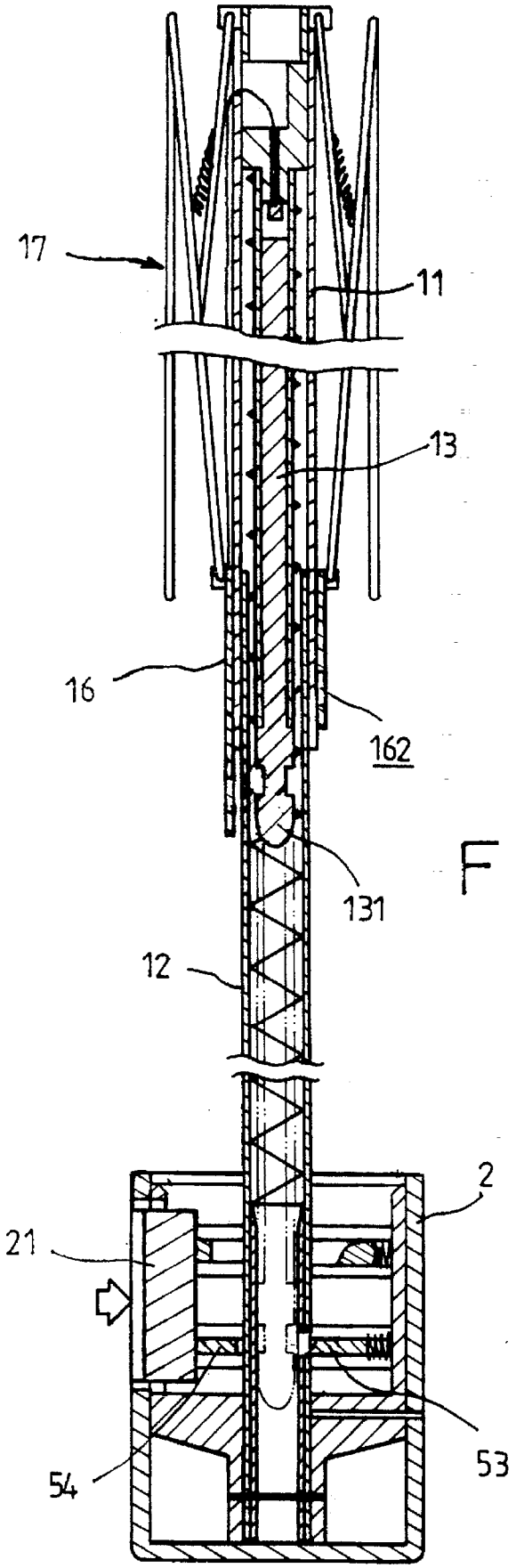
FIG. 5 is a cross-sectional view of the umbrella showing the closing of the umbrella.

To open the umbrella by directly press the button (21), as shown in FIG. 4, the upper lock plate (4) will be moved and the tongue (43) leaves the engaging groove (162). The runner (16) moves upwardly and drives the umbrella rib assembly (17) to open. The lower lock plate (5) will not be moved at this time because the ringside (54) is stopped by the extending plate (161) of the runner (16). After the runner (16) has moved upwardly, the lower lock plate (5) can be moved if a user press the button (21) at this moment. As shown in FIG. 5, the tongue (53) leaves the bullet-shaped end (131) of the mandrel (13). As a result, the mandrel moves upwardly to close the umbrella.

I claim:

1. An automatically collapsible umbrella, comprising a main function body formed by a combination of all umbrella shall, consisting of an inner tube and all outer tube, a mandrel, a positioning rod, and springs, with an umbrella rib assembly by means of a holding ring and runner; and characterized in that:

(A) insider the umbrella handle is control mechanism comprising a main body located inside the handle having a rectangular hole formed on one side which is in a position corresponding to a rectangular opening on the umbrella handle that receives a button;

two elongated grooves formed in the main body being perpendicular to the hole on the main body to engage with two corresponding lock plates; the upper ring-shape lock plate having an outward projection being capable of receiving a spring and having the opposite ringside to contact with inner face of the button; an inward tongue formed related to the projection;

the lower lock plate being similar to the upper lock plate having a projection with a spring, a ringside contacting with inner face of the button, and a related tongue with curving face; the ringside being wider than the ringside of the upper lock plate;

(B) the runner having a downward extending plate and an engaging groove on its other side;

when assembling, the inner tube with a sleeve being connected to the control mechanism wherein the tongue of the lower lock plate is inserted into the inner tube and the sleeve.

* * * * *